United States Patent [19]

Berkeley

[11] Patent Number: 4,498,933

[45] **Date of Patent: * Feb. 12, 1985**

[54] DIPHASE DRAIN CLEANER WITH HALOGENATED ALIPHATIC SOLVENT

[75] Inventor: Bernard Berkeley, Evanston, Ill.

[73] Assignee: Hysan Corporation, Chicago, Ill.

[ * ] Notice: The portion of the term of this patent subsequent to Jun. 12, 2001 has been disclaimed.

[21] Appl. No.: 589,953

[22] Filed: Mar. 15, 1984

Related U.S. Application Data

[63] Continuation-in-part of Ser. No. 374,450, May 3, 1982, Pat. No. 4,453,983.

[51] Int. Cl.[3] ..... B08B 3/08; B08B 9/02

[52] U.S. Cl. ..... 134/22.14; 134/40; 252/143

[58] Field of Search ..... 134/22.14, 40; 252/143

[56] References Cited

U.S. PATENT DOCUMENTS

| | | | |
|---|---|---|---|
| 663,479 | 12/1900 | Waitt . | |
| 676,842 | 11/1901 | Byrnes . | |
| 856,644 | 6/1907 | Laverty . | |
| 2,063,972 | 12/1936 | Adams et al. | 252/143 |
| 2,987,425 | 6/1961 | Shaw | 134/28 |
| 3,060,125 | 10/1962 | Sims | 252/153 |
| 3,085,918 | 4/1963 | Sherliker | 134/30 |
| 3,538,008 | 11/1970 | Ancel et al. | 252/146 |
| 3,553,145 | 1/1971 | Butke et al. | 252/170 |
| 3,553,146 | 1/1971 | Butke et al. | 252/170 |
| 3,576,751 | 4/1971 | Noznick et al. | 252/162 |
| 3,666,670 | 5/1972 | Gilbert et al. | 252/160 |
| 3,794,523 | 2/1974 | Thompson | 134/3 |
| 4,096,871 | 6/1978 | Van Vlahakis | 134/40 |

*Primary Examiner*—Marc L. Caroff

*Attorney, Agent, or Firm*—Cook, Wetzel & Egan, Ltd.

[57] ABSTRACT

A diphase drain cleaning composition and method wherein the composition has two liquid layers. The lower, denser layer makes up from 50 to 99 percent of the total composition weight while the upper, less-dense layer makes up from 1 to 50 percent of the total composition weight. The lower layer consists of at least 20 percent sulfuric acid solution. The upper layer consists of a halogenated aliphatic hydrocarbon polystyrene solvent and, optionally, fully saturated aliphatic hydrocarbons. The composition attacks drain blockage consisting of polystyrene and other organic and inorganic matter in two phases. First, the lower layer of sulfuric acid contacts the blockage and melts and dissolves many organic and inorganic materials. Second, loosened polystryene, which is not affected by the sulfuric acid, floats to the upper layer where it is dissolved by the solvent making up the upper layer.

21 Claims, No Drawings

DIPHASE DRAIN CLEANER WITH HALOGENATED ALIPHATIC SOLVENT

BACKGROUND OF THE DISCLOSURE

This patent application is a continuation-in-part of co-pending patent application Ser. No. 374,450 entitled Diphase Drain Cleaner, now U.S. Pat. No. 4,453,983.

Sulfuric acid has been used to clear drains of many organic materials, including fats, hair, paper, cotton, tea, coffee grounds and tobacco, as well as some inorganic materials such as chalk, hard water salts, lime scale and iron scales. The properties of sulfuric acid which make it effective for drain cleaning include: (1) its high heat of dilution in contact with residual water in the drain which melts fats, greases and low melting point compounds that otherwise act as clogging sites for other debris; (2) its reactivity with a wide range of function groups such as hydroxyl, carbonyls, esters, unsaturated bonds, rings and amino groups; and (3) its high dissociation constant that helps dissolve many organic and inorganic materials. Notable examples of use of sulfuric acid to clean drains are U.S. Pat. Nos. 3,538,008 to Ancel et al. and 4,096,871 to Vlahakis.

Unfortunately, sulfuric acid will not affect polystyrene. Consequently, it is desirable to combine sulfuric acid with a polystyrene solvent in a single drain cleaning drain cleaning system. However, many polystyrene solvents are reactive with sulfuric acid and they have not previously been employed together in a stable two-phase drain cleaning composition.

Previous drain cleaning compositions and processes that utilize hydrocarbon solvents include U.S. Pat. Nos. 3,553,145 and 3,553,146 to Butke et al., 3,666,670 to Gilbert et al., 3,576,751 to Noznick et al., and 3,060,125 to Sims. None of the disclosed compositions use halogenated hydrocarbon solvents specifically for dissolution of polystyrene.

The Diphase Drain Cleaner patent application identified above was primarily directed to halogenated aromatic hydrocarbon polystyrene solvents. The present application is, in comparison, directed to halogenated aliphatic hydrocarbon polystyrene solvents.

It is an object of the present invention to provide an improved two layer composition for diphase cleaning of a drain utilizing selected halogenated aliphatic polystyrene solvent.

It is another object of the present invention to provide a method of cleaning a drain using a diphase composition of sulfuric acid and selected halogenated aliphatic polystyrene solvents.

DESCRIPTION OF THE INVENTION

I have discovered that certain organic solvents and solvent blends will not be attacked by sulfuric acid. These solvents form a layer above sulfuric acid and dissolve polystyrene while not being affected by, or having an affect upon sulfuric acid. A stable diphase composition is formed. Further, the two layers produce a synergistic effect. The heat produced by the sulfuric acid reacting with water present in the drain drastically increases the polystyrene dissolving powers of the solvent layer. The solvent layer also acts to wash down the sides of the drain as the drain blockage is removed and to act as a "cover" for unwanted smells from sulfuric acid reaction products.

The composition of the invention consists of two mutually immiscible liquid layers. The lower and denser layer makes up from 50 to 99 percent of the total composition weight and consists of at least 20 percent sulfuric acid solution. The preferred composition uses 93 percent sulfuric acid solution for the lower layer.

The sulfuric acid solution should be of sufficient concentration and volume to make a sulfuric acid solution of at least 10% concentration after dilution with water in the drain. Normally, about four ounces of water will sit above a clogged drain. Therefore, a minimum amount of four ounces of at least 25% sulfuric acid solution is required. Of course, less volume of a more concentrated solution would be necessary.

The upper less-dense layer makes up from 1 to 50 percent of the total composition weight and consists of selected halogenated aliphatic hydrocarbon polystyrene solvents such as carbon tetrachloride; dichloroethane; trichloroethane; trichloroethylene; dichloropropane; tetrachloroethane; pentachloroethane; and perchloroethylene. The invention contemplates the upper layer composed of any of these substances or a combination of two or more of the substances.

The upper less-dense layer may include saturated aliphatic hydrocarbons to reduce the necessary amount of halogenated aliphatic hydrocarbon in that layer. Substances such as mineral oil and mineral spirits, containing saturated cyclic hydrocarbons, are adequate for this purpose. The upper layer can be up to 99% by weight saturated hydrocarbons, being up to almost 5% of the total composition weight. At least 1% by weight of the upper layer should be any of the halogenated aliphatic hydrocarbons listed above or any combination thereof. That is, the active ingredients in the upper layer are the halogenated aliphatic hydrocarbons which should make up at least 0.01% of the total composition weight.

A preferred composition consists of a lower layer being 95% of total composition weight and consisting of 93% sulfuric acid solution. A solvent blend makes up the upper layer, being 5% of the total composition weight. The solvent blend is composed of equal amounts of weight of the halogenated aliphatic hydrocarbon and the saturated aliphatic hydrocarbons. Alternatively, the solvent blend may vary from 95% by weight saturated hydrocarbons and 5% by weight halogenated aliphatic, to 100% by weight halogenated aliphatics.

The particular polystyrene solvents used in the upper layer blend were selected because of two criteria: (1) they must be stable in contact with concentrated sulfuric acid; and (2) they must be effective polystyrene solvents when in a layer above concentrated sulfuric acid. In order to determine which solvents meet these criteria, stability and effectiveness studies were conducted.

STABILITY STUDY

The following results were obtained for storage of five cubic centimeters of a candidate solvent in a layer above and in contact with ninety/five cubic centimeters of concentrated sulfuric acid (93%) at room temperature in glass containers.

| 5 cc Solvent Over 95 cc 93% Sulfuric Acid | |
|---|---|
| Solvent | Observation |
| methyl ethyl ketone | Layer gone in 1 day. |
| chlorothene NU(1) | Reacts releasing sulfur dioxide. |

-continued

| 5 cc Solvent Over 95 cc 93% Sulfuric Acid | |
|---|---|
| Solvent | Observation |
| pinene | Layer gone in 1 day. |
| dipentene | Layer gone in 1 day. |
| ethyl benzoate | Layer gone in 7 days. |
| methyl benzoate | Layer gone in 7 days. |
| ethyl proprionate | Layer gone in 7 days. |
| sodium xylene sulfonate | Forms gel in 7 days. |
| isopropyl alcohol | Layer gone in 7 days. |
| ethyl alcohol | Layer gone in 7 days. |
| octyl alcohol | Layer gone in 14 days. |
| toluene | Layer gone in 26 days. |
| xylene | Layer gone in 26 days. |
| paraxylene | Layer ⅓ gone in 26 days. |
| mesitylene | Forms crystals in sulfuric acid in 7 days. |
| methylene chloride | Layer gone in 31 days. |
| orthochlorotoluene | Layer remains over 90 days. |
| Freon 113(2) | Layer remains over 90 days. |
| perchloroethylene | Layer remains over 90 days. |
| orthodichlorobenzene | Layer remains over 90 days. |
| a blend of orthodichlorobenzene and paradichlorobenzene (1:1) | Layer remains over 90 days. |
| carbon tetrachloride | Layer remains over 90 days. |
| 1,2 dichloroethane | Layer remains over 90 days. |
| 1,1,1 trichloroethane | Layer remains over 90 days. |
| 1,1,2 trichloroethylene | Layer remains over 90 days. |
| 1,2 dichloropropane | Layer remains over 90 days. |
| 1,1,2 trichloroethane | Layer remains over 90 days. |
| 1,1,2,2 tetrachloroethane | Layer remains over 90 days. |
| 1,1,1,2,2 pentachloroethane | Layer remains over 90 days. |
| trichloromonofluoromethane | Layer remains over 90 days. |
| Mineral Spirits | Layer essentially unchanged over 90 days; sulfuric significantly darkened. |
| 140 Solvent(3) | Layer essentially unchanged over 90 days; sulfuric significantly darkened. |
| OB #140(3) | Layer essentially unchanged over 90 days; sulfuric significantly darkened. |
| Odorless Mineral Spirits(3) | Layer essentially unchanged over 90 days; sulfuric significantly darkened. |
| 135 Solvent(3) | Layer essentially unchanged over 90 days; sulfuric significantly darkened. |
| Odorless Base #3(3) | Layer essentially unchanged over 90 days; sulfuric significantly darkened. |
| Alkylate 21(4) | Layer essentially unchanged over 30 days; sulfuric darkened. |
| Alkylate 200(5) | Layer essentially unchanged over 30 days; sulfuric darkened. |
| Alkylate 300(5) | Layer essentially unchanged over 30 days; sulfuric darkened. |
| Isopar E(6) | Layer essentially unchanged over 90 days; sulfuric darkened. |
| Isopar M(6) | Layer essentially unchanged over 30 days; sulfuric darkened. |
| DC 200, 100 cs.(7) | Essentially unchanged over 90 days. |
| Kaydol(8) | Essentially unchanged over 90 days; sulfuric slightly darkened. |
| Klearol(8) | Essentially unchanged over 90 days; sulfuric slightly darkened. |

(1)Dow Chemical Co. principally 1,1,1-trichloroethane plus significant amounts of inhibitors.
(2)E. I. DuPont De Nemours, Inc., - trichlorotrifluoroethane
(3)Technical Petroleum Co.
(4)Chevron Chem. Co. - mono-alkyl benzene
(5)Chevron Chem. Co. - mono- and di-alkyl benzene
(6)Exxon Oil - isoparaffinic hydrocarbon
(7)Dow Chem. Co. - dimethyl siloxane
(8)Witco Co. - refined mineral oil Additional stability data was obtained for storage of five cubic centimeters of the candidate solvent in a layer above and in contact with ninety-five cubic centimeters of 84% sulfuric acid solution at 100° F. in glass containers. The results are set forth below.

| 5 cc Solvent in 95 cc 84% Sulphuric Acid Stored at 100° F. | |
|---|---|
| Solvent | Observations |
| toluene | Layer reduced 50% in 26 days; sulfuric slightly yellow. |
| xylene | Layer reduced 50% in 26 days; sulfuric very slightly yellow. |
| paraxylene | Layer reduced 25% in 26 days. |
| Alkylate 21 | Layer essentially unchanged in 26 days. |
| Alkylate 300 | Layer essentially unchanged except for color. |

EFFECTIVENESS STUDY

The study of the effectiveness of candidate solvents in a layer above sulfuric acid for dissolving polystyrene was conducted using the following procedure:

(1) A Pyrex measuring cup was placed on an acid resistant surface;

(2) An empty polystyrene drinking cup was placed in the center of the Pyrex container;

(3) The following items were placed in the polystyrene cup:

a paper towel a teaspoon of Crisco a piece of Kotex
a tea bag
a cigarette or cigarette butt;

(4) The polystyrene cup was filled about half way with water; and (5) The solvent-acid system was added to the contents of the polystyrene cup.

The results of these tests are summarized below:

| | Effectiveness Study | |
|---|---|---|
| | wt. % | Observations |
| Test 1 | | |
| sulfuric acid, 93% | 95.00 | Breaks through cup in 2 |
| OB 140 | 4.75 | minutes. Cup rapidly |
| orthochlorotoluene | .25 | dissolves in mixture. |
| | 100.00 | |
| Test 2 | | |
| sulfuric acid, 93% | 95.00 | Stays in cup |
| OB 140 | 5.00 | overnight. No apparent |
| | 100.00 | action |
| Test 3 | | |
| sulfuric acid, 93% | 95.00 | Stays in cup |
| OB 140 | 4.95 | overnight. There is |
| orthochlorotoluene | .05 | slight attack on cup |
| | 100.00 | but no enough to break through. |
| Test 4 | | |
| sulfuric acid, 93% | 95.00 | Breaks through cup in |
| xylene | 5.00 | less than 2 minutes. |
| | 100.00 | Cup rapidly dissolves in mixture. |
| Text 5 | | |
| sulfuric acid, 93% | 95.00 | Breaks through cup in |
| toluene | 5.00 | less than 2 minutes. |
| | 100.00 | Cup rapidly dissolves in mixture. |
| Test 6 | | |
| sulfuric acid, 93% | 95.00 | Breaks through cup in |
| orthochlorotoluene | 5.00 | less than 2 minutes. |
| | 100.00 | Cup rapidly dissolves in mixture. |
| Test 7 | | |
| sulfuric acid, 93% | 95.00 | Stays in cup |
| kerosene | 5.00 | overnight. No apparent |
| | 100.00 | action. |
| Test 8 | | |
| sulfuric acid, 84% | 95.00 | Breaks through cup in 2 |
| OB 140 | 4.75 | minutes. Cup rapidly |
| orthochlorotoluene | .25 | dissolves in mixture. |
| | 100.00 | |
| Test 9 | | |
| sulfuric acid, 93% | 95.00 | Breaks through cup in 2 |
| orthodichloro- | 5.00 | minutes. Cup rapidly |
| benzene | | dissolves in mixture. |
| | 100.00 | |
| Test 10 | | |
| sulfuric acid, 93% | 95.00 | Breaks through cup in 2 |
| OB 140 | 2.50 | minutes. Cup rapidly |
| orthodichloro- | 2.50 | dissolves in mixture. |
| benzene | | |
| | 100.00 | |
| Test 11 | | |
| sulfuric acid, 93% | 95.00 | Stays in cup |
| OB 140 | 4.75 | overnight. There is |
| orthodichloro- | .25 | slight attack on cup |
| benzene | | but not enough to break |
| | 100.00 | through. |
| Test 12 | | |
| sulfuric acid, 93% | 95.00 | Breaks through cup in |
| OB 140 | 2.50 | 2 minutes. Cup |
| carbon tetrachloride | 2.50 | dissolves in mixture. |
| | 100.00 | |
| Test 13 | | |
| sulfuric acid, 93% | 95.00 | Breaks through cup in |
| OB 140 | 2.50 | 2 minutes. Cup |
| 1,2 dichloroethane | 2.50 | dissolves in mixture. |
| | 100.00 | |
| Test 14 | | |
| sulfuric acid, 93% | 95.00 | Breaks through cup in |
| OB 140 | 2.50 | 2 minutes. Cup |
| 1,1,1 trichloroethane, uninhibited | 2.50 | dissolves in mixture. |
| | 100.00 | |
| Test 15 | | |
| sulfuric acid, 93% | 95.00 | Breaks through cup in |
| OB 140 | 2.50 | 2 minutes. Cup |
| 1,1,2 trichloro- | 2.50 | dissolves in mixture. |
| ethylene | | |
| | 100.00 | |
| Test 16 | | |
| sulfuric acid, 93% | 95.00 | Breaks through cup in |
| perchloroethylene | 2.50 | 2 minutes. Cup |
| OB 140 | 2.50 | dissolves in mixture. |
| | 100.00 | |
| Test 17 | | |
| sulfuric acid, 93% | 90.00 | Breaks through cup in |
| OB 140 | 5.00 | 2 minutes. Cup |
| orthodichloro- | 5.00 | dissolves in mixture. |
| benzene | | |
| | 100.00 | |
| Test 18 | | |
| sulfuric acid, 93% | 95.00 | Breaks through cup in |
| OB 140 | 2.50 | 2 minutes. Cup |
| 1,2 dichloropropane | 2.50 | dissolves in mixture |
| | 100.00 | |
| Test 19 | | |
| sulfuric acid, 93% | 95.00 | Breaks through cup in |
| OB 140 | 2.50 | 2 minutes. Cup |
| 1,1,2 trichloro- | 2.50 | dissolves in mixture. |
| ethane | | |
| | 100.00 | |
| Test 20 | | |
| sulfuric acid, 93% | 95.00 | Cup breaks through in 2 |
| OB 140 | 2.50 | minutes. Cup dissolves |
| 1,1,2,2 tetra- | 2.50 | in mixture. |
| chloroethane | | |
| | 100.00 | |
| Test 21 | | |
| sulfuric acid, 93% | 95.00 | Cup breaks through in 2 |
| pentachloroethane | 2.50 | minutes. Cup dissolves |
| OB 140 | 2.50 | in mixture. |
| | 100.00 | |
| Test 22 | | |
| sulfuric acid, 93% | 95.00 | Cup breaks through in 2 |
| OB 140 | 4.50 | minutes, but the cup |
| hexachloroethane | .50 | does not dissolve in |
| | 100.00 | mixture. |
| Test 23 | | |
| sulfuric acid, 93% | 95.00 | The cup breaks through |
| OB 140 | 2.50 | but the Freon |
| trichloromonofluoro- | 2.50 | solublizes before the |
| methan | | cup dissolves. |
| | 100.00 | |

Additional ingredients such as a corrosion inhibitor, dye or stable fragrance may be added to make the composition more commercially desirable.

Drains are cleaned by the diphase composition in a unique manner. The denser sulfuric acid layer comes in contact with water and the drain blockage. It melts and dissolves fats, hair, paper, cotton, tea, coffee grounds and tobacco, chalk, hard water salts, lime scale, iron salts, and other organic and inorganic substances which may cause drain blockage. Polystyrene material in the drain blockage is not affected by the sulfuric acid but will be released from the drain blockage as the other substances are melted and dissolved. The free polystyrene will float to the upper less-dense layer of halogenated aliphatic hydrocarbons where it is dissolved. Although the density of the sulfuric acid solution will vary with its strength, it will normally be denser than the halogenated aliphatic layer and will, consequently, be the lower layer in the composition. This guarantees initial contact of the sulfuric acid with the drain blockage.

The following examples demonstrate possible diphase drain cleaning compositions.

EXAMPLE I

95% by weight 93% sulfuric acid is combined with 5% by weight carbon tetrachloride to produce a two layer composition.

EXAMPLE II

60% by weight 40% sulfuric acid is combined with 20% by weight of 1,1,1-trichloroethane and 20% by weight of saturated aliphatic hydrocarbons to form a two layer composition for cleaning drains.

EXAMPLE III

50% by weight 80% sulfuric acid is combined with 49.75% by weight saturated aliphatic hydrocarbons and 0.25% by weight pentachloroethane to produce a diphase drain cleaning composition.

While the invention presently disclosed is considered to be the preferred embodiment of the invention, it is understood that changes, modifications and substitutions may be made therein without departing from the true scope of the invention as defined in the claims.

What is claimed is:

1. A stable diphase drain cleaning composition comprising a more dense layer in contact with a less dense layer, the more dense layer consisting essentially of at least 20% sulfuric acid solution, and the less dense layer consisting essentially of a polystyrene solvent selected from the group consisting of carbon tetrachloride, dichloroethane, trichloroethane, trichloroethylene, dichloropropane, tetrachloroethane, pentachloroethane, perchloroethylene and mixtures thereof.

2. The diphase drain cleaning composition of claim 1 wherein the more dense layer comprises from 50% to 99% by weight of the total composition and the less dense layer comprises from 1% to 50% by weight of the total composition.

3. The diphase drain cleaning composition of claim 1 wherein the more dense layer consists essentially of about 93% sulfuric acid solution.

4. The diphase drain cleaning composition of claim 1 wherein the sulfuric acid solution comprises about 95% by weight of the total composition.

5. The diphase drain cleaning composition of claim 1 wherein the polystyrene solvent comprises about 2.5% by weight of the total composition.

6. A stable diphase drain cleaning composition comprising a more dense layer in contact with a less dense layer, the more dense layer consisting essentially of at least 20% sulfuric acid solution, and the less dense layer consisting essentially of a blend of a polystyrene solvent selected from the group consisting of carbon tetrachloride, dichloroethane, trichloroethane, trichloroethylene, dichloropropane, tetrachloroethane, pentachloroethane, perchloroethylene, and mixtures thereof, and of fully saturated aliphatic hydrocarbons.

7. The diphase drain cleaning composition of claim 6 where the more dense layer comprises from 50% to 99% by weight of the total composition and the less dense layer comprises from 1% to 50% by weight of the total composition.

8. The diphase drain cleaning composition of claim 6 wherein the more dense layer consists essentially of about 93% sulfuric acid solution.

9. The diphase drain cleaning composition of claim 6 wherein the sulfuric acid solution comprises about 95% by weight of the total compostion.

10. The diphase drain cleaning composition of claim 6 wherein the polystyrene solvent comprises about 2.5% by weight of the total composition.

11. The diphase drain cleaning composition of claim 7 wherein up to 49.75% by weight of the total composition is fully saturated aliphatic hydrocarbons.

12. The diphase drain cleaning composition of claim 10 wherein the fully saturated aliphatic hydrocarbons comprises 2.5% by weight of the total composition.

13. A diphase drain cleaning process comprising contacting drain plumbing with a composition consisting essentially of at least 20% sulfuric acid solution and a polystyrene solvent selected from the group consisting of carbon tetrachloride, dichloroethane, trichloroethane, trichloroethylene, dichloropropane, tetrachloroethane, pentachloroethane, perchloroethylene and mixtures thereof, wherein the sulfuric acid solution and the polystyrene solvent form two layers of liquid inside the drain plumbing.

14. A diphase cleaning process comprising contacting drain plumbing with a composition consisting of a more dense layer and a less dense layer in contact, the more dense layer is a solution consisting essentially of at least 20% sulfuric acid and the less dense layer consists essentially of a blend of a polystyrene solvent selected from the group consisting of carbon tetrachloride, dichloroethane, trichloroethane, trichloroethylene, dichloropropane, tetrachloroethane, pentachloroethane, perchloroethylene, and mixtures thereof, and a solution of fully saturated aliphatic hydrocarbons.

15. The diphase drain cleaning process of claims 13 or 14 wherein the sulfuric acid solution is about 93% sulfuric acid.

16. The diphase sulfuric acid process of claims 13 or 14 wherein the sulfuric acid solution dissolves organic material in drain blockage and the polystyrene solvent dissolves polystyrene.

17. The diphase drain cleaning process of claims 13 or 14 wherein the sulfuric acid solution dissolves organic and inorganic material in drain blockage containing polystyrene thereby releasing polystyrene from the blockage to float to the polystyrene solvent layer where it is dissolved.

18. A method for cleaning from a drain a blockage containing polystyrene and one or more organic and inorganic substances and covered by water prevented from draining through the blockage, said method comprising the steps of:

providing a two phase composition consisting essentially of at least 50% by weight of an aqueous solution of sulfuric acid of at least 20% concentration, as a heavier phase, and up to 50% by weight of a lighter phase consisting essentially of a polystyrene solvent, with the lighter phase floating atop the heavier phase and being immiscible therewith, said polystyrene solvent being one which is substantially unaffected by said sulfuric acid;

adding said two phase composition to said blocked drain;

contacting the blockage and the water in the blocked drain initially with said heavier sulfuric acid while maintaining the lighter phase containing said polystyrene solvent above the blockage and above the sulfuric acid;

melting or dissolving said organic and inorganic substances in said blockage as a result of said sulfuric acid contacting said blockage;

releasing said polystyrene from said blockage, as a result of said melting or dissolving of the other substances in the blockage, thereby causing the polystyrene to float upwardly into said lighter phase located above the sulfuric acid;

and then dissolving the polystyrene which has floated upwardly in said lighter phase.

19. A method as recited in claim 18 and comprising:

diluting said sulfuric acid with the water in the blocked drain;

generating heat at the blockage as a result of diluting said sulfuric acid with the water in the blocked drain;

and increasing the polystyrene dissolving powers of the lighter phase as a result of the heat generated by the dilution of the sulfuric acid with the water in the blocked drain.

20. A method as recited in claim 18 and comprising:

diluting said sulfuric acid with the water in the blocked drain;

and adding said two phase composition to said blocked drain in sufficient quantity to make a sulfuric acid solution of no less than 10% concentration after dilution thereof with the water in said blocked drain.

21. A method as recited in claim 18 wherein:

said lighter phase also comprises a fully saturated aliphatic hydrocarbon.

* * * * *